US012577003B2

(12) United States Patent
Rodi

(10) Patent No.: US 12,577,003 B2
(45) Date of Patent: Mar. 17, 2026

(54) CLOSING DEVICE AND METHOD FOR CLOSING FOLDABLE PACKAGES

(71) Applicant: Uhlmann Pac-Systeme Gmbh & Co. KG, Laupheim (DE)

(72) Inventor: Wolfgang Rodi, Laupheim (DE)

(73) Assignee: UHLMANN PAC-SYSTEME GMBH & CO. KG, Laupheim (DE)

( * ) Notice: Subject to any disclaimer, the term of this patent is extended or adjusted under 35 U.S.C. 154(b) by 92 days.

(21) Appl. No.: 18/434,176

(22) Filed: Feb. 6, 2024

(65) Prior Publication Data

US 2024/0262547 A1 Aug. 8, 2024

(30) Foreign Application Priority Data

Feb. 7, 2023 (EP) ..... 23155347

(51) Int. Cl.
*B65B 7/20* (2006.01)

(52) U.S. Cl.
CPC ..... *B65B 7/20* (2013.01)

(58) Field of Classification Search
CPC ..... B31B 50/0042; B31B 50/54; B31B 2120/102; B31B 2110/35; B65B 7/20
See application file for complete search history.

(56) References Cited

U.S. PATENT DOCUMENTS 5,170,608 A 12/1992 Petry et al.
2016/0347020 A1* 12/2016 Kamph ..... B31B 50/99

FOREIGN PATENT DOCUMENTS

GB 429960 A 6/1935
NL 9000886 A 11/1991

OTHER PUBLICATIONS

European Search Report from EP 23155347.0 dated Aug. 16, 2023.

* cited by examiner

*Primary Examiner* — Thomas M Wittenschlaeger
(74) *Attorney, Agent, or Firm* — Dickinson Wright PLLC

(57) ABSTRACT

A method for closing foldable packages and a closing device has a first support element having a first support surface on which a bottom flap of a package can be arranged, and a second support element having a second support surface on which a top flap of the package can be arranged. A first push-in bar and a second push-in bar of the closing device are moveable along a movement path which has in some portions a component parallel to a first transverse direction in order to push the package in the first transverse direction. By doing so, the bottom flap and the top flap are folded towards a frame of the package.

16 Claims, 7 Drawing Sheets

CLOSING DEVICE AND METHOD FOR CLOSING FOLDABLE PACKAGES

CROSS-REFERENCE TO RELATED APPLICATIONS

This application claims the benefit of and priority under 35 U.S.C. § 119 to European Patent Application No. 23 155 347.0, filed Feb. 7, 2023, the contents of which is incorporated herein by reference in its entirety.

FIELD

The present disclosure relates to a closing device and a method for closing foldable packages, in particular folding boxes or foldable trays.

BACKGROUND

Foldable packages, for example folding boxes or foldable trays, generally comprise a frame or base having a plurality of side walls, and at least one bottom flap and at least one top flap for closing the package. Such foldable packages can be stored, transported and supplied to a packaging process in a space-saving manner in the form of a substantially planar blank. The blanks are then erected and the at least one bottom flap and the at least one top flap are closed by means of suitable devices. To this end, the at least one bottom flap and the at least one top flap have to be folded along a fold in the direction of the frame. This frequently takes place by correspondingly configured guiding and deflector systems, wherein the packages are moved along said guiding and deflector systems by means of a conveying device. Depending on the size of the packages to be processed and the bottom and top flaps thereof, the fragility of the packages, and the design of the conveying device, the use of suitable guiding and deflector systems is not always readily possible in the case of limited installation space.

SUMMARY

The present disclosure provides a closing device and a method for closing foldable packages which permit a reliable closure of the packages in the case of limited installation space.

According to an aspect of the present disclosure, a closing device for closing foldable packages, each package having a frame, a bottom flap and a top flap, comprises a conveying device for conveying the packages along a conveying path in a conveying direction, wherein the conveying device comprises a plurality of receivers, wherein each receiver has a bearing surface which delimits the receiver in a first transverse direction perpendicularly to the conveying direction and on which a package can be arranged. The closing device further comprises a first support element having a first support surface, and a second support element having a second support surface, wherein the first support surface and the second support surface are arranged in one plane and spaced apart from the bearing surfaces of the plurality of receivers, and wherein the first support element and the second support element are arranged spaced apart from one another in a second transverse direction, wherein the bottom flap of an open package is arrangeable on the first support surface, the top flap of the open package is arrangeable on the second support surface, and the frame of the open package is arrangeable above the bearing surface, wherein the second transverse direction is oriented perpendicularly to the first transverse direction and to the conveying direction. Additionally, the closing device comprises a first push-in bar and a second push-in bar each extending substantially parallel to the conveying direction. Each of the first push-in bar and the second push-in bar is cyclically movable along a movement path, wherein the movement path has at least in some portions a component parallel to the first transverse direction in order to push the package in the first transverse direction and, at the same time, to fold the bottom flap and the top flap towards the frame.

In this manner, the bottom flap and the top flap can be folded by means of the actively movable push-in bars and the support elements towards the frame, even when the available space is limited and/or the bottom flap and the top flap of the package cannot be closed, or only closed with difficulty, by conventional stationary guiding or deflecting means in a receiver of the conveying device. Since the bottom flap and the top flap bear at least partially against the first support surface and the second support surface, respectively, and are retained thereby, the bottom flap and the top flap are folded towards the frame when the first push-in bar and the second push-in bar are moved parallel to the first transverse direction, come into contact with the package, in particular in a region of a fold between the bottom flap or the top flap and the frame, and push the package parallel to the first transverse direction into the receiver. In other words, the first support element and the first push-in bar are configured to fold the bottom flap towards the frame, and the second support element and the second push-in bar are configured to fold the top flap towards the frame. The first support element and the second support element each form an abutment.

If a movement or a movement path herein has a component parallel to a specific direction, the movement or movement path can have either only this component, i.e. run parallel to this direction, or additionally it can have a superimposed further component in a further direction. In the latter case, the movement or movement path runs obliquely to the specific direction and to the further direction but at least also in said specific direction.

According to an aspect of the present disclosure, the closing device comprises a plurality of foldable packages.

The conveying device preferably comprises a plurality of receivers which are arranged one behind the other with respect to the conveying direction. The conveying device may comprise a plurality of delimiting elements which delimit the plurality of receivers. Preferably, each receiver is delimited at a front with respect to the conveying direction by at least one first leg of a front delimiting element, and is delimited at a rear opposite to the conveying direction by at least one first leg of a rear delimiting element. The first legs extend substantially parallel to the first transverse direction. Each receiver is also delimited downwardly with respect to the first transverse direction by the bearing surface. The bearing surface can be formed by a second leg of the front and/or rear delimiting element. The second leg extends substantially parallel to the conveying direction. The delimiting elements can be configured, for example, as cell angles. The first support surface, the second support surface, the first push-in bar and the second push-in bar are preferably provided at least in a start region of the closing device. The installation space required in the conveying direction can be minimized by the packages preferably being inserted into the closing device in the start region. In particular, an erected open package is inserted in each case into a receiver of the conveying device. As a result, directly after insertion into the closing device, the bottom flap and the top flap of the package can be folded by means of the first push-in bar and the second push-in bar without a movement in the conveying direction being required. However, it is also conceivable to supply the packages to the start region in the conveying direction.

The first support surface and the second support surface are arranged in one plane spaced apart from the bearing surface in the first transverse direction, in particular from the bearing surface of the receiver arranged in the start region. This plane is parallel to the bearing surface or the bearing surfaces of the plurality of receivers. At least in the start region of the closing device, the first support element and the second support element comprise the first support surface and the second support surface, respectively. As a result, the open packages can be inserted into the closing device such that the bottom flap and the top flap already bear at least partially against the first support surface and the second support surface, respectively, and can then be directly reshaped by means of the push-in bars.

Since the first support element and the second support element are arranged spaced apart from one another in the second transverse direction, the frame does not bear against the first support surface and the second support surface. Rather, the frame can be arranged spaced apart from the bearing surface, substantially according to the distance between the first support surface and the second support surface. As a result, the package can be pushed in the first transverse direction in the region of the frame by means of the first push-in bar and the second push-in bar. In other words, the first support element and the second support element are arranged on both sides of the conveying path of the packages. The first support element and the second support element can delimit the conveying path in the second transverse direction to both sides. In general, the first support element and the second support element are preferably arranged in a stationary manner.

The packages are preferably made of cardboard, corrugated card, paper or the like, or from comparable materials, including plastics.

The packages can be folding boxes (also referred to as folded boxes) or foldable trays for receiving products. Folding boxes are used, for example, for receiving cosmetics or pharmaceutical products, such as for example blister packs filled with tablets. Foldable trays can be used for receiving solid products, such as for example containers, small bottles, vials or syringes, in particular for medical or pharmaceutical products. A tray has at least one recess in at least one side wall for receiving such a solid product.

Foldable packages may each comprise a frame (also referred to as a base) which preferably has a plurality of side walls, in particular four side walls, at least one bottom flap and at least one top flap. A frame may also have more than four side walls, optionally also fewer side walls. For example, the frame may comprise at least two portions, in particular cuboidal portions, which in each case have four side walls and which are connected by a common side wall. Solid products can be received between the two portions of the package. In this case, the package can have at least one bottom flap and at least one top flap in each portion.

In an erected state of the package, adjacent side walls of the frame are preferably oriented substantially perpendicularly to one another. As a result, the frame is substantially cuboidal and open on two opposing sides. In each case, two adjacent side walls of the frame are connected along a common fold. The frame may also have multiple layers or may be provided with additional elements in the interior, for example for reinforcement or for receiving the product.

In a first embodiment, exactly one bottom flap and exactly one top flap are provided, wherein the bottom flap and the top flap each adjoin a first side wall of the frame along a fold. The bottom flap and the top flap can close the frame, in particular on the two open front sides, and can be configured, for example, as push-in flaps. The package can also comprise dust flaps. Such a construction is used, for example, in folding boxes.

In a preferred second embodiment, each package has a frame, at least a first bottom flap and a second bottom flap and at least a first top flap and a second top flap. In this case, dust flaps can be dispensed with. The first bottom flap and the first top flap adjoin a first side wall of the frame along a respective fold. The second bottom flap and the second top flap adjoin a second side wall of the frame opposite the first side wall along a respective fold. The first bottom flap and the second bottom flap are arranged on one side of the frame and the first top flap and the second top flap are arranged on a side of the frame opposite the first and second bottom flap. Such a construction is used, for example, in foldable trays. If such a construction has a plurality of portions, as described above, this preferably applies to each portion.

In an erected and open state of the package, the first bottom flap and the first top flap are arranged substantially in one plane with the first side wall of the frame. In this state, the packages are preferably arranged in the start region of the closing device such that the first bottom flap is arranged on the first support surface and the first top flap is arranged on the second support surface, while the first side wall of the frame is located above the bearing surface in the first transverse direction. This also applies to the first embodiment.

In an erected and closed state of the package, the first bottom flap and the first top flap are preferably arranged substantially perpendicularly to the first side wall. In the erected and closed state, the second bottom flap and the second top flap are preferably arranged substantially perpendicularly to the second side wall. Moreover, in the closed state, the first bottom flap and the second bottom flap may engage with one another and the first top flap and the second top flap may engage with one another in order to close and stabilize the package.

In principle, the features described herein relative to the packages may be applied and transferred to different embodiments of the packages. If it is referred to a bottom flap and a top flap herein, this may be the first bottom flap and the first top flap of the second embodiment which are provided in combination with the second bottom flap and the second top flap. The basic construction of such foldable packages is known to a person skilled in the art and it goes without saying that slight deviations from the described ideal arrangement of the package may result due to gravity and due to restoring forces of the material.

It might be conceivable to arrange the first push-in bar and the second push-in bar relative to the conveying direction downstream of the start region and to move the packages, in particular the bottom flap and the top flap, below the first push-in bar and the second push-in bar by means of the conveying device.

Preferably, however, the first push-in bar and the second push-in bar can each be moved along the movement path, wherein, in a first movement portion, the movement path has a component parallel to the second transverse direction in order to move the first push-in bar and the second push-in bar above the first bottom flap and the top flap, respectively. This facilitates a construction of the closing device which is space-saving in the conveying direction, since the first push-in bar and the second push-in bar can be moved above the bottom flap and the top flap, respectively, already in the start region in which the packages are inserted into the closing device.

In a second movement portion, the movement path of the first push-in bar and the second push-in bar thus has the component parallel to the first transverse direction in order to push the package in the first transverse direction. After a package has been inserted into the closing device in the start region, initially the first push-in bar can be arranged above the bottom flap and the second push-in bar can be arranged above the top flap before these flaps are then folded towards the frame by moving the first push-in bar and the second push-in bar parallel to the first transverse direction. If the first and the second bottom flap and the first and the second top flap are provided, due to the first movement portion the first push-in bar can initially enter between the first bottom flap and the second bottom flap and the second push-in bar can enter between the first top flap and the second top flap.

The first push-in bar and the second push-in bar are preferably arranged symmetrically with respect to the conveying path of the packages, in particular with respect to a plane of symmetry parallel to the conveying direction and to the first transverse direction, and can be moved in a synchronous manner. Preferably, the movement path of the first push-in bar and the movement path of the second push-in bar are configured symmetrically with respect to the plane of symmetry.

Both movement paths may have an outer extreme position in which the push-in bars are furthest away from the conveying path in the second transverse direction. Both movement paths may also have a lower extreme position in which the push-in bars have pushed the package furthest in the first transverse direction. The movement paths each run from the outer extreme position to the lower extreme position and, preferably, back to the outer extreme position from there. The outer and the lower extreme positions, therefore, indicate turning points of the push-in bars. Preferably, the course of the movement paths from the outer extreme position to the lower extreme position coincides with the course of the movement paths from the lower extreme position to the outer extreme position. However, it is also conceivable that the movement paths are configured in a looped manner.

For example, starting from the outer extreme position, the first push-in bar and the second push-in bar can be moved along the first movement portion of the movement path towards the package, and then along the second movement portion of the movement path towards the bearing surface and into the lower extreme position. The first and second movement portions preferably transition from one to another continuously.

The fact that the movement path in the first movement portion has a component parallel to the second transverse direction means that, in the first movement portion, the first and the second push-in bar are moved at least parallel to the second transverse direction. This movement can be superimposed with a movement parallel to the first transverse direction. The fact that the movement path in the second movement portion has a component parallel to the first transverse direction means that, in the second movement portion, the first and the second push-in bars are moved at least parallel to the first transverse direction. This movement can be superimposed with a movement parallel to the second transverse direction. Preferably, however, in the first movement portion the component parallel to the second transverse direction dominates and in the second movement portion the component parallel to the first transverse direction dominates.

The first push-in bar and the second push-in bar are mounted and drivable to be movable cyclically along the respective movement path. Particularly preferably, the first push-in bar is connected to a first drive by means of a first linkage in the form of a first coupling gear and the second push-in bar is connected to a second drive by means of a second linkage in the form of a second coupling gear. The first coupling gear and the second coupling gear are configured to move the first push-in bar and the second push-in bar along the movement path, respectively. The movement path of the first push-in bar and the movement path of the second push-in bar can be adapted in a simple manner to the boundary conditions provided in the closing device by a corresponding design of the coupling gears. It is also conceivable that the first coupling gear is connected to a first drive shaft and the second coupling gear is connected to a second drive shaft, wherein the first drive shaft and the second drive shaft are driven by the same drive.

Preferably, the first coupling gear and the second coupling gear are configured in the form of a double rocker, whereby the movement paths can be implemented in a particularly space-saving manner. In particular, double rockers are suitable for realizing movement paths in which the movement from the outer extreme position into the lower extreme position and the movement from the lower extreme position back into the outer extreme position coincide. Additionally, the movement path running at least in the second transverse direction in the first movement portion and running at least in the first transverse direction in the second movement portion can thus be simply implemented.

In a preferred embodiment, the first coupling gear comprises a first member, a second member, a third member and preferably a fourth member, wherein the first member and the second member are pivotably mounted on a base frame of the closing device, wherein the third member is pivotably connected to the first member and to the second member, wherein the first push-in bar is rigidly connected to the third member, wherein the fourth member is pivotably connected to the first member, and the first drive is coupled to the fourth member. Similarly, the second coupling gear may comprise a first member, a second member, a third member and preferably a fourth member, wherein the first member and the second member are pivotably mounted on the base frame of the closing device, wherein the third member is pivotably connected to the first member and the second member, wherein the second push-in bar is rigidly connected to the third member, wherein the fourth member is pivotably connected to the first member, and the second drive is coupled to the fourth member.

In this manner, a coupling gear can be implemented in the form of a double rocker with simple components and bearing points. The first member and the second member of the first coupling gear and the second coupling gear are preferably pivotably mounted about a joint axis but are not fully rotatable about this joint axis. A first end portion of the second member is preferably mounted on the base frame of the closing device, and a second end portion is pivotably connected to the third member. The first and second push-in bar are preferably attached to a first end portion of the third member, and a first end portion of the first member is connected to a second end portion of the third member. A second end portion of the first member is preferably connected to the fourth member, wherein the first member is pivotably mounted on the base frame between the first end portion and the second end portion.

The first drive and the second drive are preferably rotary drives each having a driveshaft. Preferably, the fourth member is eccentrically mounted relative to the respective drive shaft.

The first coupling gear and the second coupling gear can be configured to convert a rotational drive movement of the first and second drive, respectively, into a movement of the first and the second push-in bar along the movement path.

Irrespective thereof, the first coupling gear and the second coupling gear are preferably configured such that a full revolution of the drive shaft of the first and second drive results in a movement of the first push-in bar and the second push-in bar, respectively, from the outer extreme position into the lower extreme position and back into the outer extreme position along the movement path.

Preferably, the first push-in bar and the second push-in bar remain in the lower extreme position until a package has been moved in the conveying direction out of the start region of the closing device and a next package is to be inserted. Then, the first and the second push-in bars are moved along the movement path into the outer extreme position. As soon as the push-in bars clear the conveying path or a receiver of the conveying device, a further package can be inserted into the closing device. The first and the second push-in bar turn around in the outer extreme position and move back towards the lower extreme position, whereby the bottom flap and the top flap of the further package are folded towards the frame.

In order to fold the bottom flap and the top flap carefully towards the frame and into a defined position, it is preferred that the first support element has a first operative surface which adjoins the first support surface and which, at least in the start region of the closing device, is inclined relative to the first transverse direction and the second transverse direction towards the conveying path, and the second support element has a second operative surface which adjoins the second support surface and which, at least in the start region, is inclined relative to the first transverse direction and the second transverse direction towards the conveying path. Generally, the length of the start region in the conveying direction preferably corresponds at least to the dimension of a package in the conveying direction.

A value of an angle from a plane, which is defined parallel to the conveying direction and to the first transverse direction, relative to the first operative surface and to the second operative surface, respectively, is preferably between 5° and 85°, more preferably between 20° and 70°. In other words, the value of an angle β from the first support surface to the first operative surface is preferably between 95° and 175°, more preferably between 110° and 160°, and the value of an angle from the second support surface to the second operative surface is preferably between 95° and 175°, more preferably between 110° and 160°.

The first support surface and the first operative surface preferably adjoin one another along a first edge which extends parallel to the conveying direction. The second support surface and the second operative surface preferably adjoin one another along a second edge which extends parallel to the conveying direction. The first edge and the second edge can be provided with a radius. The distance between the first edge and the second edge in the second transverse direction is preferably smaller than a dimension of the open package in the second transverse direction. Generally, initially the bottom flap is therefore partially arranged on the first support surface and partially above the first operative surface, and the top flap is partially arranged on the second support surface and partially above the second operative surface.

Each of the first push-in bar and the second push-in bar preferably has a substantially triangular cross section. A cross-sectional plane is defined parallel to the first transverse direction and to the second transverse direction. As a result, at least in the start region of the closing device, the first push-in bar and the second push-in bar can have the shape of a straight triangular prism. Preferably, a first side surface of the first push-in bar and a first side surface of the second push-in bar are oriented in a plane parallel to the first transverse direction and to the conveying direction so that the first and the second push-in bar can be positioned as close as possible to the frame of the package. In particular, an edge of the first push-in bar directed towards the first transverse direction can be arranged above a region of the fold between the bottom flap and the first side wall of the frame of the package, and an edge of the second push-in bar directed towards in the first transverse direction can be arranged above a region of the fold between the top flap and the first side wall of the frame of the package. Thus, with a movement of the first and the second push-in bar in the first transverse direction, the edge of the first push-in bar and the second push-in bar directed towards the first transverse direction first comes into contact with the package.

It is further preferred that the first push-in bar has an inclined side surface which, at least in the start region, is inclined relative to the first transverse direction and the second transverse direction, and that the second push-in bar has an inclined side surface which, at least in the start region, is inclined relative to the first transverse direction and the second transverse direction. The inclined side surfaces of the first and the second push-in bar preferably face away from the conveying path.

An angle of a plane, which is defined parallel to the conveying direction and to the first transverse direction, relative to the inclined side surface of the first and the second push-in bar is preferably between 5° and 85°, more preferably between 20° and 70°. This enables the bottom flap and the top flap to be folded in a manner which is as unhindered as possible in the direction of the frame when the first push-in bar and the second push-in bar are moved in the first transverse direction.

The first push-in bar and the second push-in bar have a length in the conveying direction which is preferably larger than a dimension of the packages in the conveying direction. The first push-in bar and the second push-in bar may have, at a first end, a clamping portion in which they can be connected, for example, to the coupling gear. In the clamping portion, the first push-in bar and the second push-in bar may have a rectangular cross section. The first push-in bar and the second push-in bar may have a free end portion at a second end. In the free end portion, the first and the second push-in bar may have a variable cross section. Between the clamping portion and the end portion, the first push-in bar and the second push-in bar may have a working portion in which they have the substantially triangular cross section and which is arranged in the start region of the closing device.

Preferably, at least in the start region of the closing device, the first operative surface and the inclined side surface of the first push-in bar are arranged substantially parallel to one another, and the second operative surface and the inclined side surface of the second push-in bar are arranged substantially parallel to one another. The first operative surface and the inclined side surface of the first push-in bar as well as the second operative surface and the inclined side surface of the second push-in bar may also be arranged substantially parallel to one another in their entirety.

In a preferred embodiment, in the lower extreme position of the first push-in bar and the second push-in bar, a first gap in which the bottom flap is receivable is configured between the first operative surface and the inclined side surface of the first push-in bar, and a second gap in which the bottom flap receivable is configured between the second operative surface and the inclined side surface of the second push-in bar. A height of the first gap and the second gap perpendicular to the respective operative surface is greater than or equal to the material thickness of the bottom flap and the top flap.

In the start region of the closing device, the bottom flap and the top flap are preferably folded into an intermediate position in which they are arranged substantially according to an inclination of the first operative surface and the second operative surface, respectively. The intermediate position corresponds to a position between the open and the closed state of the package.

Preferably, an inclination of the first operative surface corresponds to an inclination of the inclined side surface of the first push-in bar, and an inclination of the second operative surface corresponds to an inclination of the inclined side surface of the second push-in bar. In other words, the first operative surface and the inclined side surface of the first push-in bar always face one another and extend substantially parallel to one another. This also applies to the second operative surface and the inclined side surface of the second push-in bar.

The inclination of the first operative surface and the inclination of the second operative surface relative to the first transverse direction and the second transverse direction may change continuously along the conveying direction in order to fold the bottom flap and the top flap further towards the frame. Preferably, at an end of the first and second gap, the first operative surface and the second operative surface are arranged substantially perpendicularly to the second transverse direction. The first and second gap are thus increasingly inclined over their path in the conveying direction, so that the bottom flap and the top flap are folded towards the frame.

The first push-in bar and the second push-in bar are preferably configured to taper in the conveying direction, in particular in the end portion oriented in the conveying direction. As a result, a width of the first push-in bar and the second push-in bar parallel to the second transverse direction is reduced. As a result, the first gap and the second gap phase out into the conveying path at an end of the first and second push-in bar, respectively, which is located downstream in the conveying direction. The bottom flap and the top flap are then in an end state in which they can be held by the first and the second support element or further components of the closing device which follow the first and the second support element in the conveying direction. In the start region, however, the first push-in bar and the second push-in bar should not be tapered in the conveying direction.

According to another aspect of the present disclosure, a method for closing foldable packages, each package having a frame, a bottom flap and a top flap, comprises the steps of:

arranging an open package such that the bottom flap of the package bears against a first support surface of a first support element, the top flap of the package bears against a second support surface of a second support element, and the frame of the package is arranged above and spaced apart from a bearing surface of a receiver for the package in a first transverse direction;

arranging a first push-in bar above the bottom flap and a second push-in bar above the top flap;

moving each of the first push-in bar and the second push-in bar along a respective movement path which has at least in some portions a component parallel to the first transverse direction; and pushing the package in the first transverse direction towards the bearing surface by means of the first push-in bar and the second push-in bar during their movement along the movement path, wherein the bottom flap is folded towards the frame by the first support element and the top flap is folded by the second support element.

In this manner, the bottom flap and the top flap can be folded towards the frame by means of the actively movable push-in bars and the support elements, even when the available space is limited and/or the bottom flap and the top flap of the package cannot be closed, or only with difficulty, in a receiver of the conveying device by conventional stationary guiding or deflecting means. Since the bottom flap and the top flap bear at least partially against the first support surface and the second support surface, respectively, and are retained thereby, the bottom flap and the top flap are folded towards the frame when the first push-in bar and the second push-in bar are moved parallel to the first transverse direction, come into contact with the package, in particular in a region of a fold between the bottom flap or the top flap and the frame, and push the package parallel to the first transverse direction into the receiver.

Unless described otherwise, the steps of the method are preferably carried out in the respectively specified sequence.

Particularly preferably, the method is carried out by means of the closing device described herein. All of the features and advantages described with respect to the closing device thus apply in an analogous manner to the method and vice versa. In particular, the functions and movement sequences of the closing device and its components can thereof be formulated as method steps.

The method may comprise repeating the specified steps for each package of a plurality of packages. Generally, the foldable packages are preferably packages as described above, in particular folding boxes or foldable trays.

The step of arranging the open package on the first and the second support element is preferably carried out such that the frame of the package is arranged above a free space between the first support element and the second support element. Thus, the package can be moved in the first transverse direction towards the bearing surface, as soon as the first push-in bar and the second push-in bar move in the first transverse direction and come into contact with the package.

Irrespective thereof, the step of arranging the package on the first and the second support element preferably comprises inserting the package into the closing device, in particular into a receiver of the plurality of receivers of the conveying device. The package may be inserted between a front delimiting element and a rear delimiting element of a receiver of the plurality of receivers, but does not bear against the bearing surface of the receiver. The insertion may take place in a start region of the closing device. The package is open and preferably erected when inserted, or is erected during the insertion.

In principle, it is advantageous if the method is carried out in an automated manner. Arranging the package in the closing device is preferably carried out by means of a transfer device. The transfer device may be configured to receive at least one package and to insert the package into the closing device, in particular into a receiver of the plurality of receivers.

The first push-in bar and the second push-in bar are preferably mounted and drivable such that they can be arranged above the bottom flap and the top flap, respectively, and can be moved along the movement path, for example by means of the first coupling gear and the second coupling gear, as described above. In particular, the first push-in bar can be driven by the first drive and the second push-in bar can be driven by the second drive.

The step of arranging the first push-in bar above the bottom flap and the second push-in bar above the top flap may take place by moving the package below the first push-in bar and the second push-in bar. To this end, the package may be inserted into the closing device upstream of the first push-in bar and the second push-in bar with respect to the conveying direction, and then be moved in the conveying direction. For a compact design of the closing device, however, it is advantageous that the step of arranging the first push-in bar above the bottom flap and the second push-in bar above the top flap comprises the step of moving the first push-in bar above the bottom flap and the second push-in bar above the top flap along a first movement portion of the movement path in which the movement path has a component parallel to the second transverse direction. The step of moving the first push-in bar and the second push-in bar, at least in some portions with a component parallel to the first transverse direction, preferably takes place along a second movement portion of the movement path. In this manner, in the start region, the package can be arranged on the first support element and the second support element, and, in this position of the package, the first push-in bar and the second push-in bar may be moved above the bottom flap and the top flap, respectively, and then in the first transverse direction for folding the flaps. The constructional space required in the conveying direction is minimized thereby.

The bottom flap and the top flap may be folded into an intermediate position by pushing the package in the first transverse direction. Preferably, the method also comprises conveying the package in the conveying direction by means of the conveying device which comprises the receiver, and folding the bottom flap and the top flap from the intermediate position into an end position by means of the first support element and the second support element, respectively. The first support element and the second support element are preferably arranged in a stationary manner while conveying the packages in the conveying direction. Preferably, this generally applies to the closing device as well as to the entire method.

In the intermediate position, the bottom flap is preferably received in the first gap between the first support element and the first push-in bar and the top flap is received in the second gap between the second support element and the second push-in bar. The first gap and the second gap are preferably inclined relative to the first transverse direction and the second transverse direction. Folding the bottom flap and the top flap into the end position may result from the inclination of the first gap and the inclination of the second gap changing relative to the first transverse direction and the second transverse direction along the conveying direction, preferably until the first and the second gap are oriented substantially parallel to the first transverse direction.

In order to be able to move the frame of the package between the first support element and the second support element towards the bearing surface, a first distance between the first support element and the second support element in the second transverse direction is preferably larger than a dimension of the frame in the second transverse direction. So that the bottom flap and the top flap of the open package can be arranged on the first support surface and the second support surface, respectively, the first distance is preferably smaller than the sum of the dimensions of the bottom flap, the frame and the top flap in the second transverse direction.

DETAILED DESCRIPTION

Figure 1:
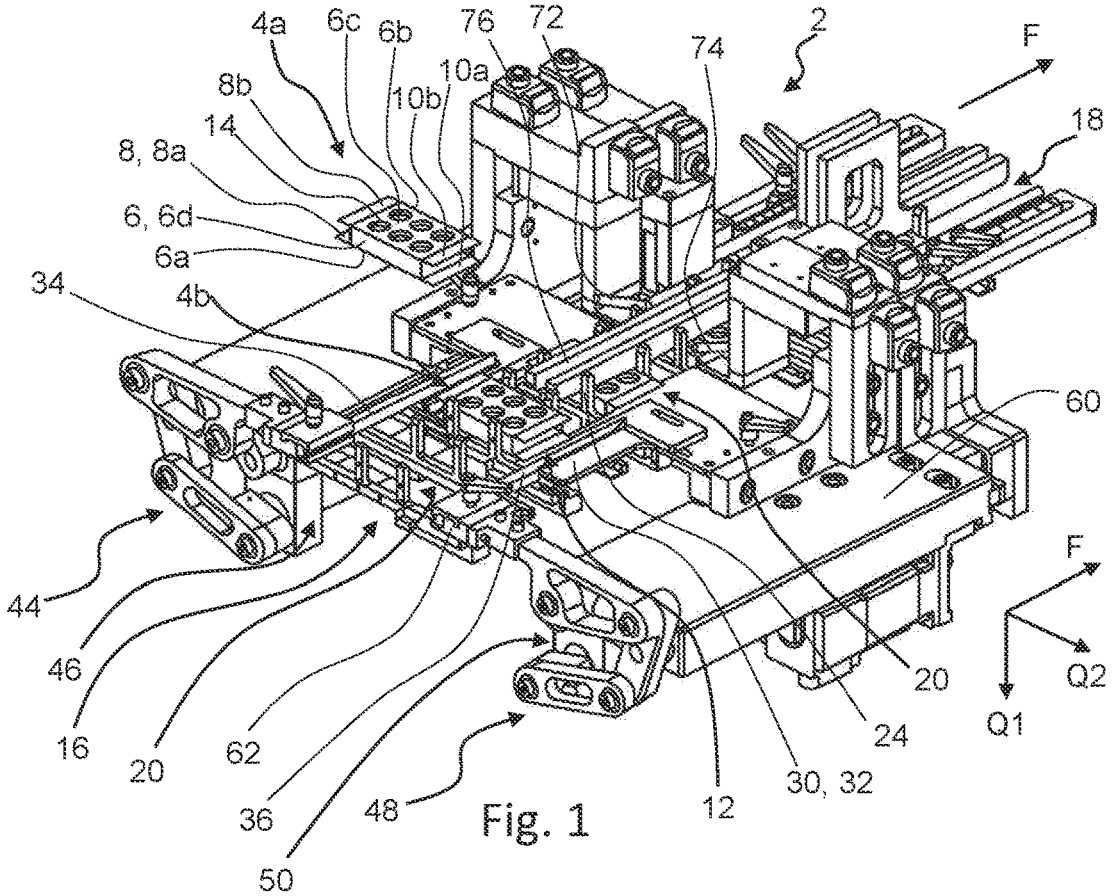
FIG. 1 shows a closing device in a perspective view.
Figure 2:
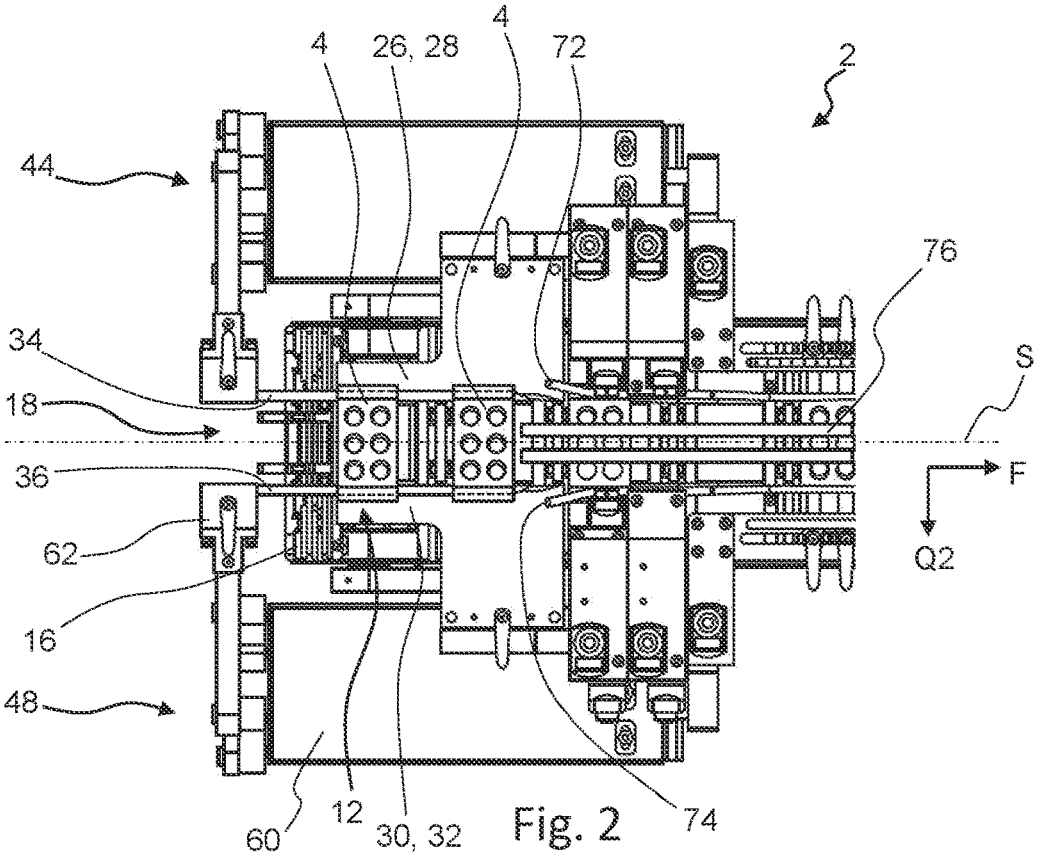
FIG. 2 shows the closing device of FIG. 1 in a plan view.
Figure 3:
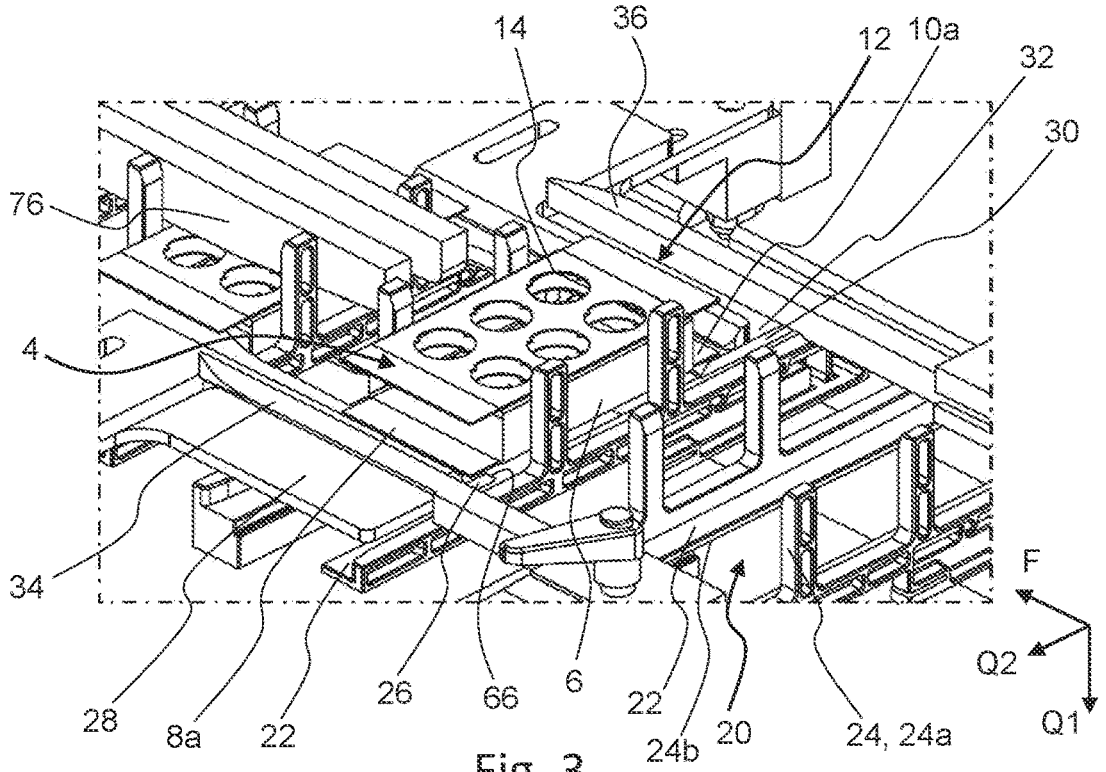
FIGS. 3-7 show a detail of the closing device of FIG. 1 during a method for closing packages in a perspective view.

A closing device 2 according to an embodiment of the present disclosure is shown in FIGS. 1 to 3, wherein FIG. 1 shows a perspective view of the closing device 2, FIG. 2 shows a plan view of the closing device 2 and FIG. 3 shows a detailed view of the closing device 2. The closing device 2 serves for closing foldable packages 4 which in each case have a frame 6, at least one bottom flap 8 and at least one top flap 10.

In FIG. 1, a first package 4*a* of the packages 4 is shown before insertion into the closing device 2 and a second package 4*b* is shown after insertion into the closing device 2. The frame 6 of each package 4 may have four side walls 6*a*, 6*b*, 6*c*, 6*d* which are oriented substantially perpendicularly to one another in an erected state of the package 4. As a result, the frame 6 is substantially cuboidal and open on two opposing sides. In the embodiment shown, each of the packages 4 has a lower first bottom flap 8*a*, an upper second bottom flap 8*b*, a lower first top flap 10*a* and an upper second top flap 10*b*. The first bottom flap 8*a* and the first top flap 10*a* each adjoin a first side wall 6*a* of the frame 6 along a fold, and the second bottom flap 8*b* and the second top flap 10*b* each adjoin a second side wall 6*c* of the frame 6 opposing the first side wall 6*a* along a fold. The first bottom flap 8*a* and the second bottom flap 8*b* are provided on one side of the frame 6 on a first opening thereof, and the first top flap 10*a* and the second top flap 10*b* are provided on an opposing side of the frame 6 on a second opening thereof. In an open state of the package 4, the first bottom flap 8*a* and the first top flap 10*a* are arranged substantially in one plane with the first side wall 6*a* of the frame 6. In this state, the packages 4 are arranged in a start region 12 of the closing device 2, for example by being conveyed by means of a transport device (not shown) into the start region 12 or by being inserted by means of a transfer device (not shown) into the start region 12.

In the embodiment shown, the foldable packages 4 are formed by foldable trays for receiving solid products, such as for example containers, small bottles, vials or syringes. To this end, each tray has at least one recess 14 in at least one side wall 6*c* for receiving such a solid product. However, the packages 4 may also be different packages, such as for example folding boxes which can be used for receiving cosmetics or pharmaceutical products, such as blister packs.

It is also conceivable that the packages 4 each have only one bottom flap 8 and only one top flap 10. In this case, for example, each package 4 may have only the first bottom flap 8*a* as the bottom flap 8 and the first top flap 10*a* as the top flap 10. Unless described otherwise, all of the specifications herein also apply to such an embodiment.

The closing device 2 comprises a conveying device 16 for conveying the packages 4 along a conveying path 18 in a conveying direction F. The conveying device 16 comprises a plurality of receivers 20 for receiving a package 4 in each case, wherein each receiver 20 has a bearing surface 22 (see FIG. 3) which delimits the receiver 20 in a first transverse direction Q1 perpendicular to the conveying direction F and on which a package 4 can be arranged. The plurality of receivers 20 are preferably arranged one behind the other in the conveying direction F. The conveying device 16 may comprise a plurality of delimiting elements 24 which delimit the plurality of receivers 20 to the front and to the rear parallel to the conveying direction F. For example, the conveying device 16 is configured as a packaged goods transport device comprising a plurality of cell angles as the delimiting elements 24. Preferably, each delimiting element 24 has a first leg 24*a* and a second leg 24*b* which are oriented substantially perpendicularly to one another. The first leg 24*a* delimits the respective receiver 20 parallel to the conveying direction F. The second leg 24*b* delimits the respective receiver 20 parallel to the first transverse direction Q1 and defines the bearing surface 22.

The conveying direction F, the first transverse direction Q1 and a second transverse direction Q2 define a right-angled coordinate system in which the first transverse direction Q1 and the second transverse direction Q2 are oriented perpendicularly to one another and perpendicularly to the conveying direction F.

The closing device 2 further comprises a first support element 26 having a first support surface 28 and a second support element 30 having a second support surface 32. The first support surface 28 and the second support surface 32 are arranged in one plane and spaced apart from the bearing surfaces 22 of the plurality of receivers 20 in the first transverse direction Q1.

The first support element 26 and the second support element 30 are arranged spaced apart from one another in the second transverse direction Q2. The first support surface 28 and the second support surface 32 should be provided at least in the start region 12 of the closing device 2. In the start region 12 of the closing device 2, the conveying path 18 is defined between the first support element 26 and the second support element 30. A first distance D1 between the first and the second support element 26, 30 parallel to the second transverse direction Q2 corresponds at least to the dimension of the frame 6 of an inserted package 4 so that the package can be received between the first and the second support element 26, 30.

If an open, erected package 4 is arranged in a receiver 20 in the start region 12 of the closing device 2, the bottom flap 8*a* of this package 4 is at least partially arranged on the first support surface 28, the top flap 10*a* of this package 4 is arranged at least partially on the second support surface 32, and the frame 6 of this package 4 is arranged above and spaced apart from the bearing surface 22. The first distance D1 between the first and the second support element 26, 30 parallel to the second transverse direction Q2 is thus preferably smaller than a dimension of the open package 4 parallel to the second transverse direction Q2 including the bottom flap 8*a* and the top flap 10*a* protruding from the frame 6, so that the bottom flap 8*a* and the top flap 10*a* come to rest on the respective support surface 28, 32.

Figure 8:
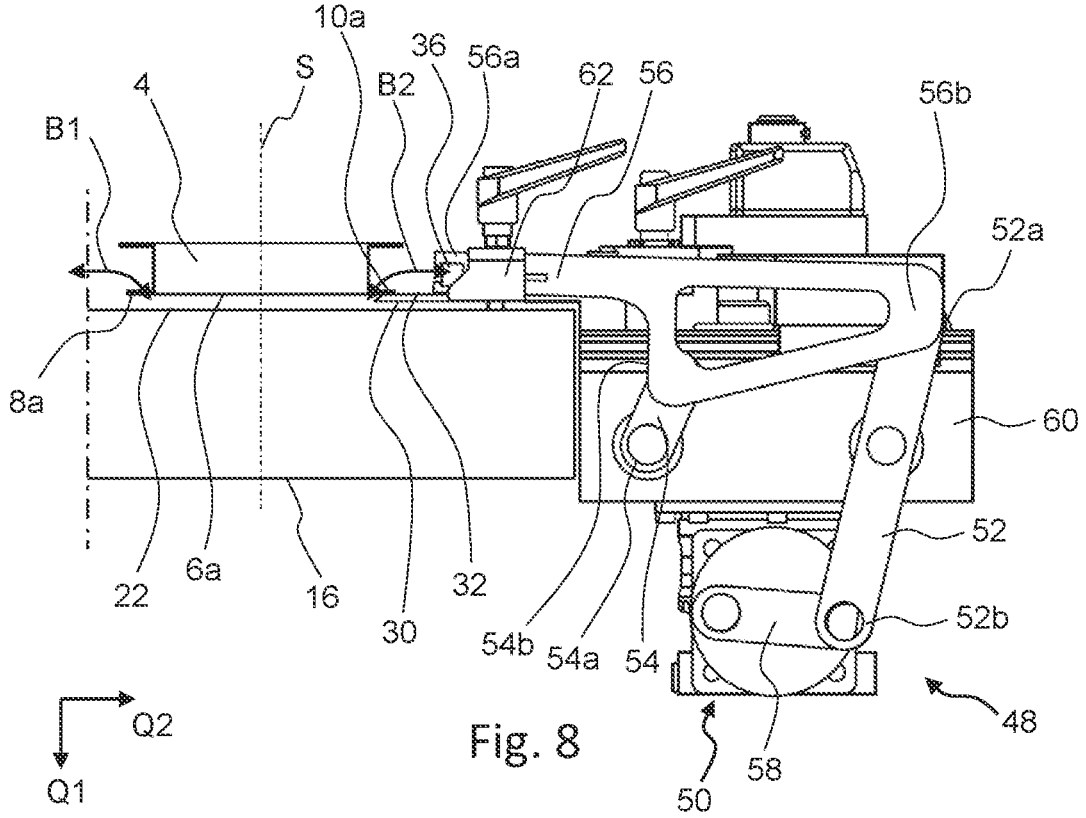
FIGS. 8-11 show a detail of the closing device of FIG. 1 during the method for closing packages in a front view.
Figure 12:
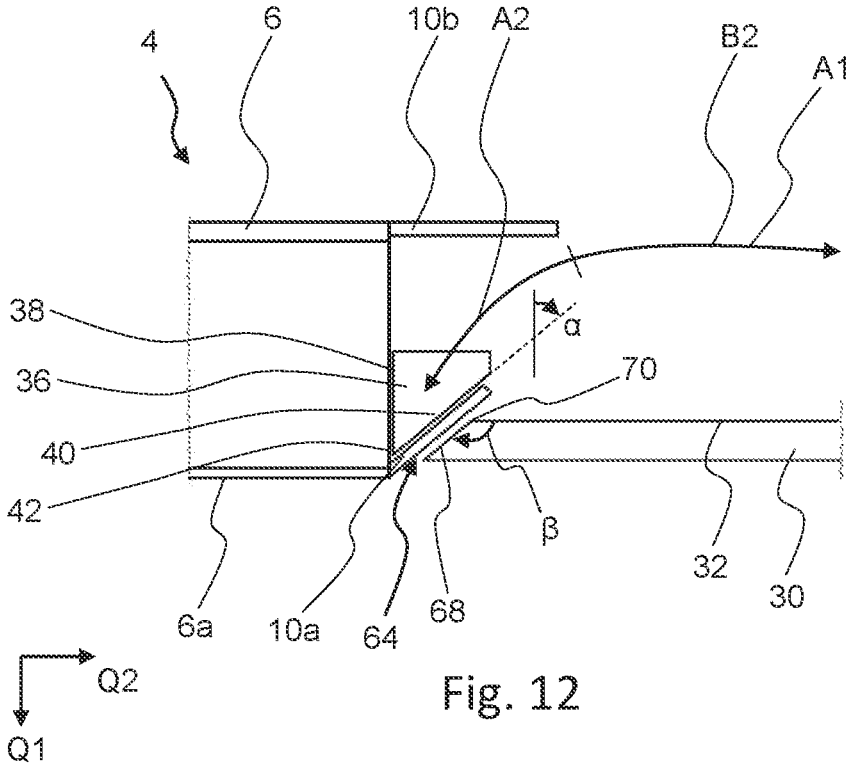
FIG. 12 shows a detailed view of the region XII in FIG. 11 in a cross-sectional view along the line XII-XII in FIG. 5.

The closing device 2 further comprises a first push-in bar 34 and a second push-in bar 36 which extend substantially parallel to the conveying direction F. The first push-in bar 34 and the second push-in bar 36 are configured to push the package 4 in the first transverse direction Q1 from the position in which the bottom flap 8*a* and the top flap 10*a* are arranged on the support elements 26, 30, thereby folding the bottom flap 8*a* and the top flap 10*a* towards the frame 6. To this end, the first push-in bar 34 and the second push-in bar 36 are movable cyclically back and forth along a movement path B which is indicated in FIGS. 8 and 12, and which has at least in some portions a component parallel to the first transverse direction Q1. A first movement path of the first push-in bar 34 (not shown) is identified in FIG. 8 by reference sign B1 and a second movement path of the second push-in bar 36 is identified by reference sign B2.

The bottom flap 8*a* and the top flap 10*a* initially bear against the first support surface 28 and the second support surface 32, respectively. During their movement along the movement path B, the first push-in bar 34 and the second push-in bar 36 come into contact with the package 4 and push the frame 6 in the first transverse direction Q1. The bottom flap 8*a* and the top flap 10*a* are retained by the first and by the second support element 26, 30 and are thereby folded about the fold between the first side wall 6*a* of the frame 6 and the respective flap 8*a*, 10*a*, as described herein in detail with reference to the method according to an embodiment of the present disclosure. Thus, it is advantageous for the first push-in bar 34 and the second push-in bar 36 to come into contact with the package 4 in a region of the fold between the frame 6 and the bottom flap 8*a* and the top flap 10*a*, respectively. The folds extend parallel to the conveying direction F.

Figure 11:
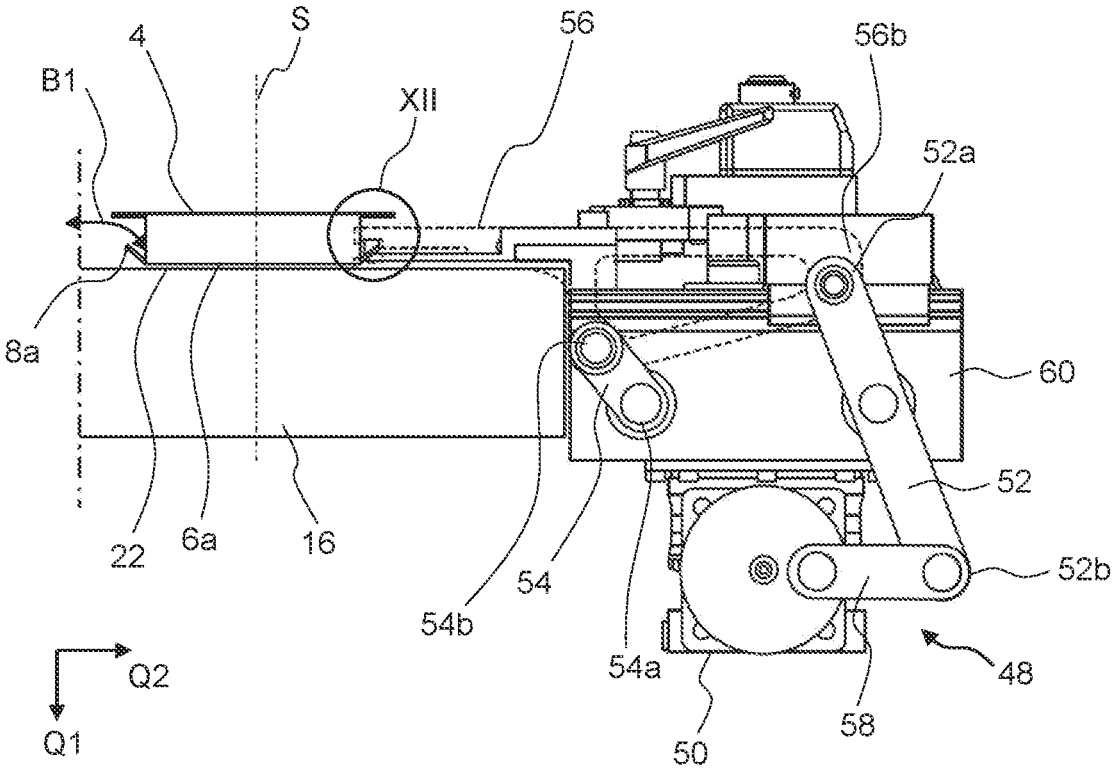

In order to be positioned as close as possible to the frame 6, and to be able to act on the bottom flap 8*a* and the top flap 10*a* in the region of the fold in a defined manner at the same time, the first push-in bar 34 and the second push-in bar 36 may, at least in the start region 12, have a substantially triangular cross section, as can be seen in FIGS. 3, 11 and 12. Referring now to FIG. 12, this is described by way of example on the basis of the second push-in bar 36, but applies equally to the first push-in bar 34. A first side surface 38 of the second push-in bar 36 is arranged in a plane parallel to the first transverse direction Q1 and to the conveying direction F and may therefore be positioned as close as possible to the frame 6, although, in a direction parallel to the conveying direction F, the push-in bar 36 protrudes on both sides over the package 4, and thus cannot enter the interior of the frame 6. An inclined side surface 40 of the second push-in bar 36, which is also denoted the second side surface 40, is inclined relative to the first transverse direction Q1 and the second transverse direction Q2. An angle $\alpha$ is defined starting from a plane, which is oriented parallel to the conveying direction F and to the first transverse direction Q1, to the inclined side surface 40 and is less than 90°.

The first side surface 38 and the second side surface 40 meet in an edge 42 which extends parallel to the conveying direction F and is directed downwardly in the first transverse direction Q1. As a result, the edge 42 may be arranged above the fold between the top flap 10*a* and the first side wall 6*a* of the frame 6 and come into contact with the package 4 in the region of the fold. The inclined second side surface 40 permits the folding of the top flap 10*a* about the edge 42 towards the frame 6.

The first push-in bar 34 and the second push-in bar 36 are preferably arranged and configured symmetrically to one another relative to a plane of symmetry S. The first movement path B1 and the second movement path B2 are preferably configured symmetrically relative to the plane of symmetry S. The plane of symmetry S is preferably oriented parallel to the conveying direction F and to the first transverse direction Q1. All of the features described with respect to one of the push-in bars 34, 36 may thus equally apply to both push-in bars 34, 36. Moreover, all of the features described with respect to one of the movement paths B1, B2 may equally apply to both movement paths B1, B2. Thus, when features are described which apply to both movement paths B1, B2, it is herein also referred to the movement path B.

For realizing the movement path B, it is possible to use coupling gears, for example in the form of double rockers, wherein the movement path B can be adapted particularly easily to the conditions in the closing device 2 by the configuration of the coupling gears. As shown in FIGS. 1, 2 and 8 the first push-in bar 34 is connected to a first drive 46 by means of a first coupling gear 44, and the second push-in bar 36 is connected to a second drive 50 by means of a second coupling gear 48. The first and the second push-in bar 34, 36 may extend, for example, counter to the conveying direction F beyond the start region 12 and may be connected to the coupling gears 44, 48 outside the start region 12, as can be seen in FIGS. 1 and 2. The first coupling gear 44 and the second coupling gear 48 are configured to convert a rotational drive movement of the first drive 46 and the second drive 50, respectively, into a movement of the first push-in bar 34 and the second push-in bar 36 corresponding to the movement path B.

The first coupling gear 44 and the second coupling gear 48 are preferably configured and arranged symmetrically relative to the plane of symmetry S. The second coupling gear 48 is described hereinafter in a representational manner on the basis of FIG. 8, wherein the first coupling gear 44 is configured in an analogous manner. The second coupling gear 48 may comprise a first member 52, a second member 54, a third member 56 and a fourth member 58. Each member is configured in a substantially bar-shaped or strip-shaped manner. The first member 52 and the second member 54 are pivotably mounted on a base frame 60 of the closing device 2. The third member 56 is pivotably connected to the first member 52 and the second member 54. The second push-in bar 36 is attached to the third member 56.

More specifically, the second push-in bar 36 is attached to a first end portion 56*a* of the third member 56, for example by means of a clamp 62 which secures a clamping portion of the second push-in bar positively and/or non-positively. As a result, the second push-in bar 36 can be easily mounted and replaced. Generally, the clamping portion of the second push-in bar 36 can have a substantially rectangular cross section.

A second end portion 56*b* of the third member 56 is connected to a first end portion 52*a* of the first member 52. A second end portion 52*b* of the first member 52 is connected to the fourth member 58, wherein the first member 52 is pivotably mounted on the base frame 60 between the first end portion 52*a* and the second end portion 52*b*. The fourth member 58 can be mounted eccentrically with respect to an axis of rotation of the second drive 50. The second member 54 is mounted on the base frame 60 in a first end portion 54*a* and connected to the third member 56 in a second end portion 54*b*.

A method for closing foldable packages 4 according to an aspect of the disclosure is described hereinafter with reference to FIG. 3 to FIG. 12, wherein FIGS. 3 to 7 are perspective views and FIGS. 8 to 12 are front views in conveying direction F. In FIGS. 8 to 11, the conveying device 16 is indicated only schematically in order to identify the bearing surface 22. The method is preferably carried out by the closing device 2 as described above. All of the features described in the context of the method also relate to the closing device 2 per se, substantially independently of the method.

As shown in FIG. 3 and FIG. 8, initially an erected open package 4 is arranged in the closing device 2 such that the bottom flap 8*a* of the package 4 bears against the first support surface 28 of the first support element 26, the top flap 10*a* bears against the second support surface 32 of the second support element 30, and the frame 6 is arranged above the bearing surface 22 and spaced apart from the bearing surface 22. The package 4 can be received in a receiver 20, in particular between a front and a rear delimiting element 24 of the receiver 20. In the meantime, the first push-in bar 34 and the second push-in bar 36 may be located in an outer extreme position of the respective movement path B, in which they are furthest away from the conveying path 18 in the second transverse direction Q2 in order to clear the receiver 20 for inserting the package 4.

Figure 4:
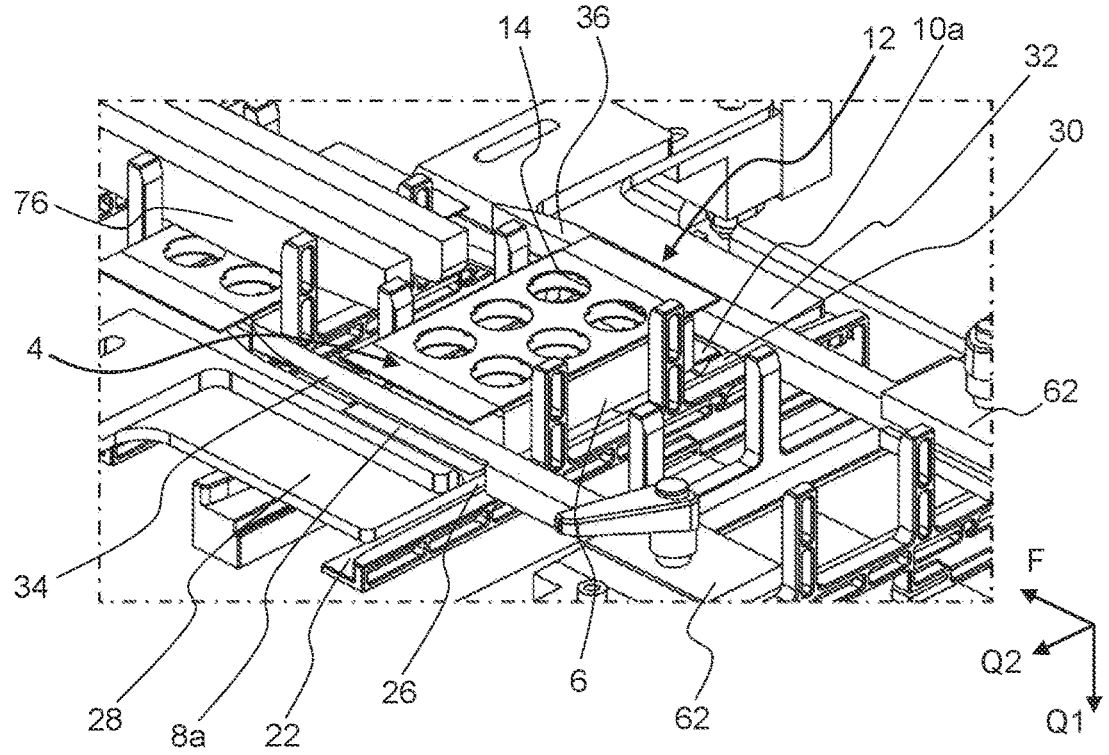
Figure 9:
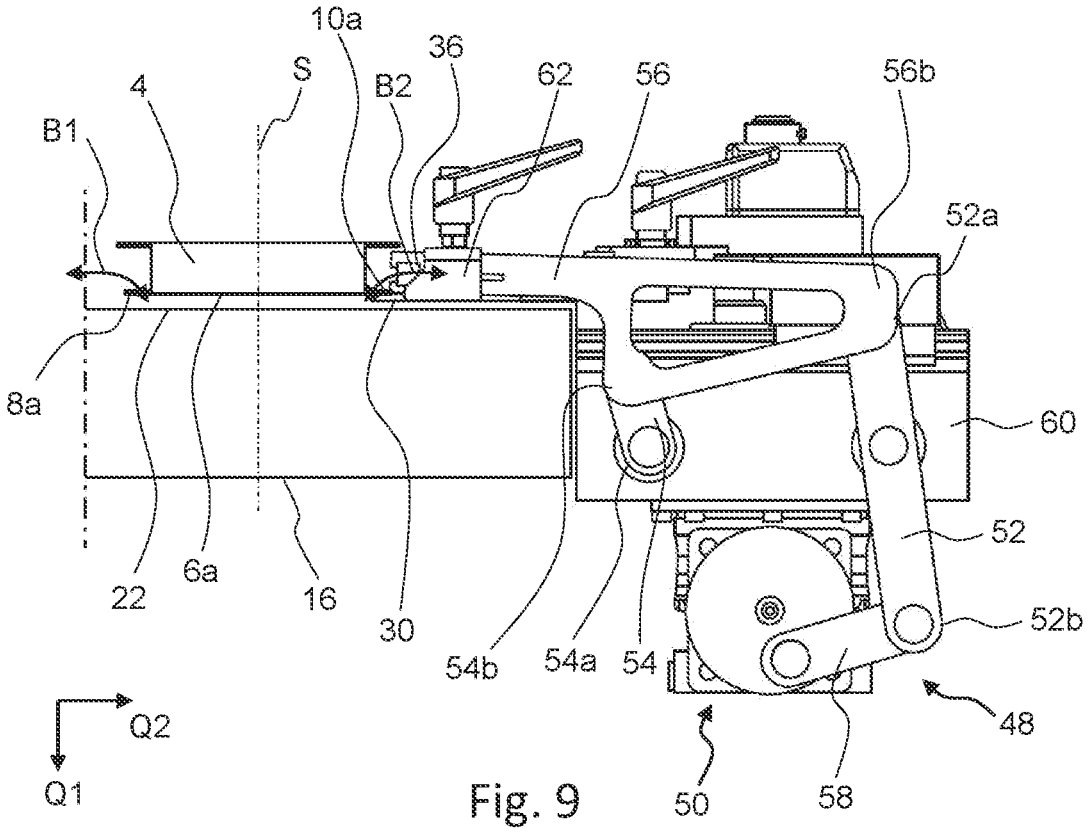
Figure 10:
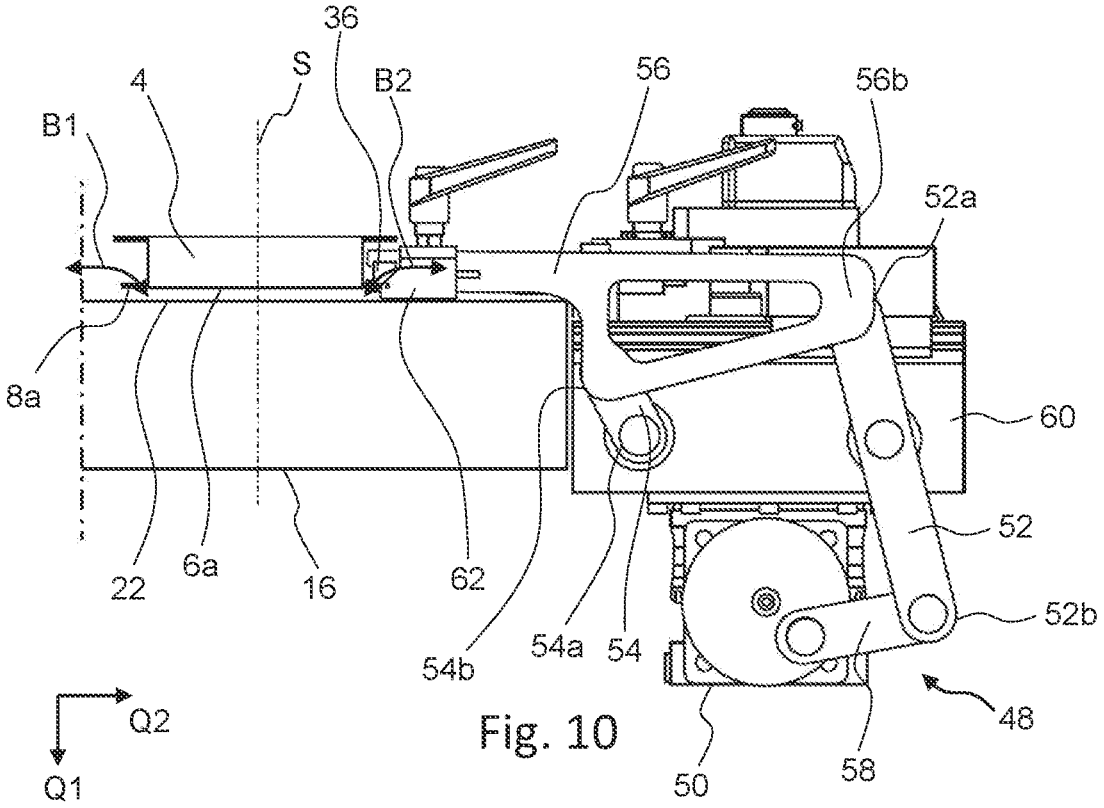

As shown in FIGS. 4, 9 and 10, the first push-in bar 34 is then arranged above the bottom flap 8*a* and the second push-in bar 36 is arranged above the top flap 10*a*. To this end, the first and the second push-in bar 34, 36 may each be moved, starting from the outer extreme position, along the first movement portion A1 of the movement path B towards the package 4. In the first movement portion A1, the movement path B has a component parallel to the second transverse direction Q2 so that the first and the second push-in bar 34, 36 are also moved at least in the second transverse direction Q2 or substantially parallel to the second transverse direction Q2. The position of the package 4 remains substantially unaltered in the meantime.

Figure 5:
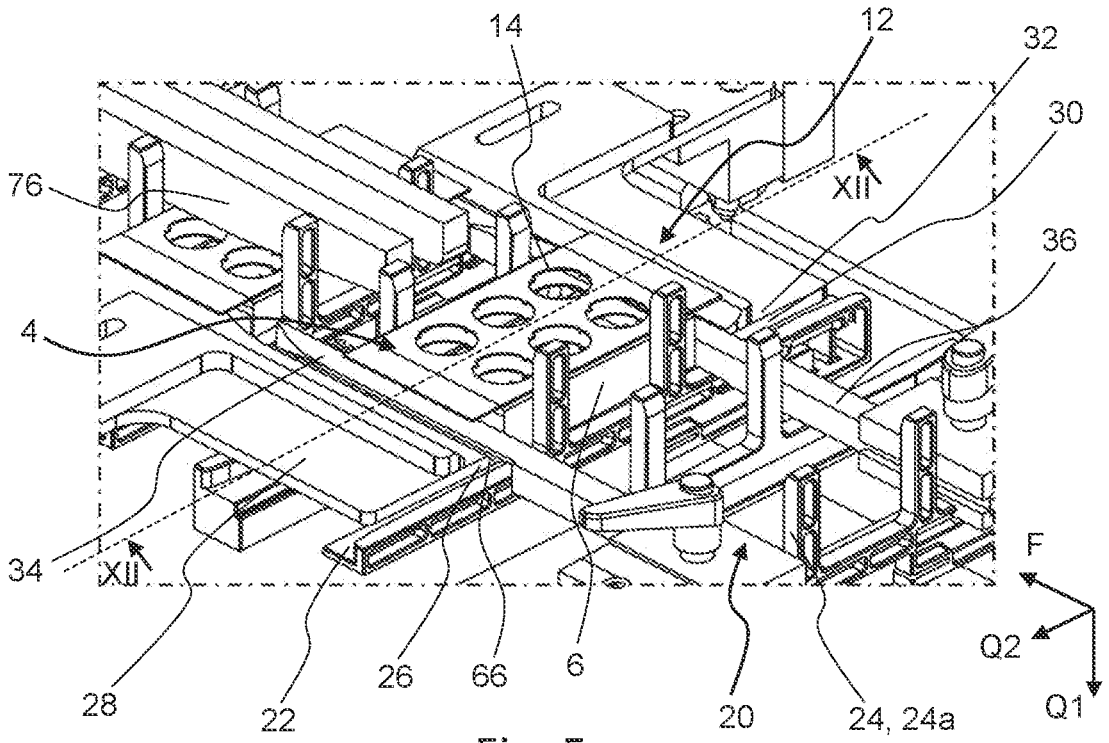

Then, the first push-in bar 34 and the second push-in bar 36 are moved along the second movement portion A2 of the movement path B in which the movement path B has a component parallel to the first transverse direction Q1, as shown in FIGS. 5 and 11 and the detailed view in FIG. 12. In the second movement portion A2, the first and the second push-in bars 34, 36 also move at least in the first transverse direction Q1 or substantially parallel to the first transverse direction Q1. With this movement, the first push-in bar 34 and the second push-in bar 36 come into contact with the package 4, in particular with an edge 42 of the push-in bars 34, 36 at the region of the fold between the bottom or top flap 8*a*, 10*a* and the frame 6. As a result, the first and the second push-in bars 34, 36 push the package 4 towards the bearing surface 22. The bottom flap 8*a* and the top flap 10*a* are retained by the first and by the second support element 26, 30 while the frame 6 is pushed towards the bearing surface 22. The bottom flap 8*a* and the top flap 10*a* are folded towards the frame 6 about the edge 43 of the first and second push-in bar 34, 36, respectively. The first and the second push-in bar 34, 36 are moved into a lower extreme position of the movement path B in which they have pushed the package 4 furthest into the first transverse direction Q1.

The movement path B of each push-in bar 34, 36 runs from the outer extreme position to the lower extreme position and from there back to the outer extreme position. The path of the movement path B from the outer extreme position to the lower extreme position may coincide with the path of the movement path B from the lower extreme position to the outer extreme position, such that as little space as possible has to be provided for the movement of the push-in bars 34, 36. Such a movement can be implemented by means of the coupling gears 44, 48.

By moving the first and the second push-in bar 34, 36 along the second movement portion A2, the bottom flap 8*a* and the top flap 10*a* are folded into an intermediate position, which is shown in FIG. 12. In the intermediate position, the bottom flap 8*a* is received in a first gap between the first support element 26 and the first push-in bar 34 and the top flap 10*a* is received in a second gap 64 between the second support element 30 and the second push-in bar 36.

The first support element 26 preferably has a first operative surface 66 (see FIG. 3) which adjoins the first support surface 28 along a first edge. Correspondingly, the second support element 30 may have a second operative surface 68 (see FIGS. 7, 12) which adjoins the second support surface 32 along a second edge 70. In the start region 12, the first operative surface 66 and the second operative surface 68 are inclined relative to the first transverse direction Q1 and the second transverse direction Q2 toward the conveying path 18. An angle β from the respective support surface 28, 32 to the corresponding operative surface 66, 68 is greater than 90° and preferably between 110° and 160° (see FIG. 12).

For forming the first gap and the second gap 64, it is preferred that, at least in the start region 12, the first operative surface 66 is oriented parallel to the inclined side surface 40 of the first push-in bar 34 and the second operative surface 68 is oriented parallel to the inclined side surface 40 of the second push-in bar 36. A distance between the inclined side surfaces 40 and the operative surfaces 66, 68 corresponds at least to the material thickness of the bottom flap 8*a* and the top flap 10*a*. As a result, in the intermediate position, the bottom flap 8*a* and the top flap 10*a* are inclined according to the inclination of the operative surfaces 66, 68 and the inclined side surfaces 40.

The inclination of the first operative surface 66 and the inclination of the second operative surface 68 relative to the first transverse direction Q1 and the second transverse direction Q2 preferably changes along the conveying direction F until the first operative surface 66 and the second operative surface 68 are oriented substantially parallel to the first transverse direction Q1 and the conveying direction F or perpendicularly to the second transverse direction Q2. The inclination of side surfaces 40 of the first and the second push-in bar 34, 36 may change accordingly, as can be seen in FIGS. 3 to 7 on the first push-in bar 34.

Figure 6:
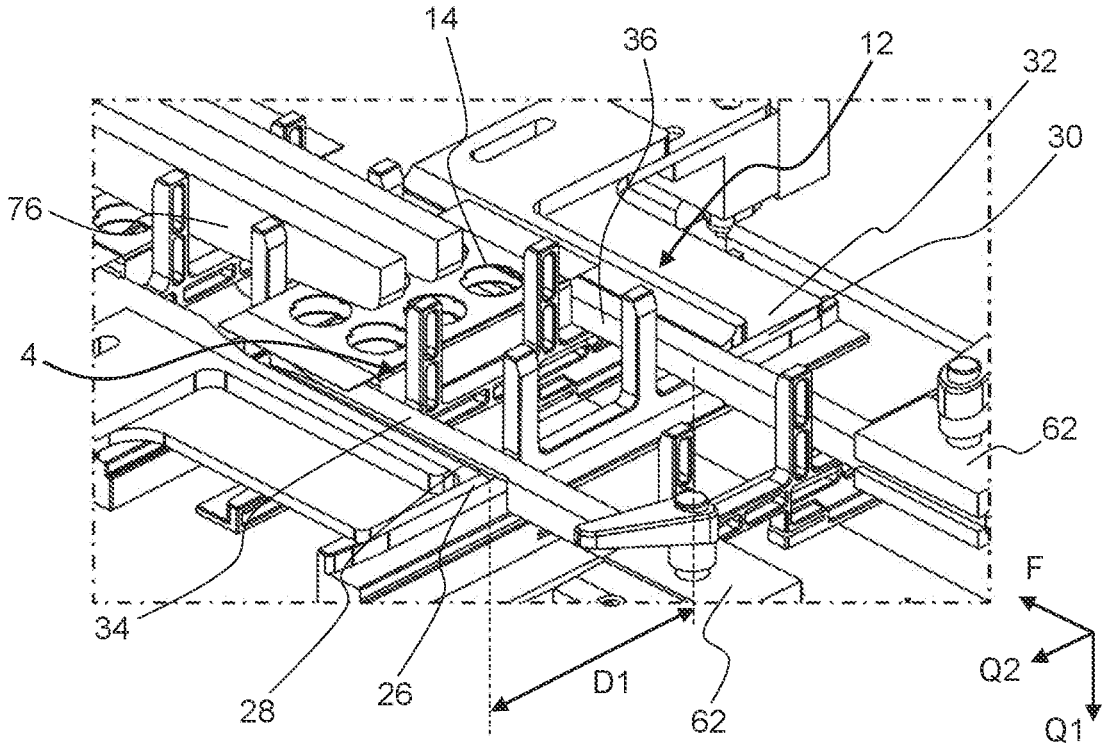
Figure 7:
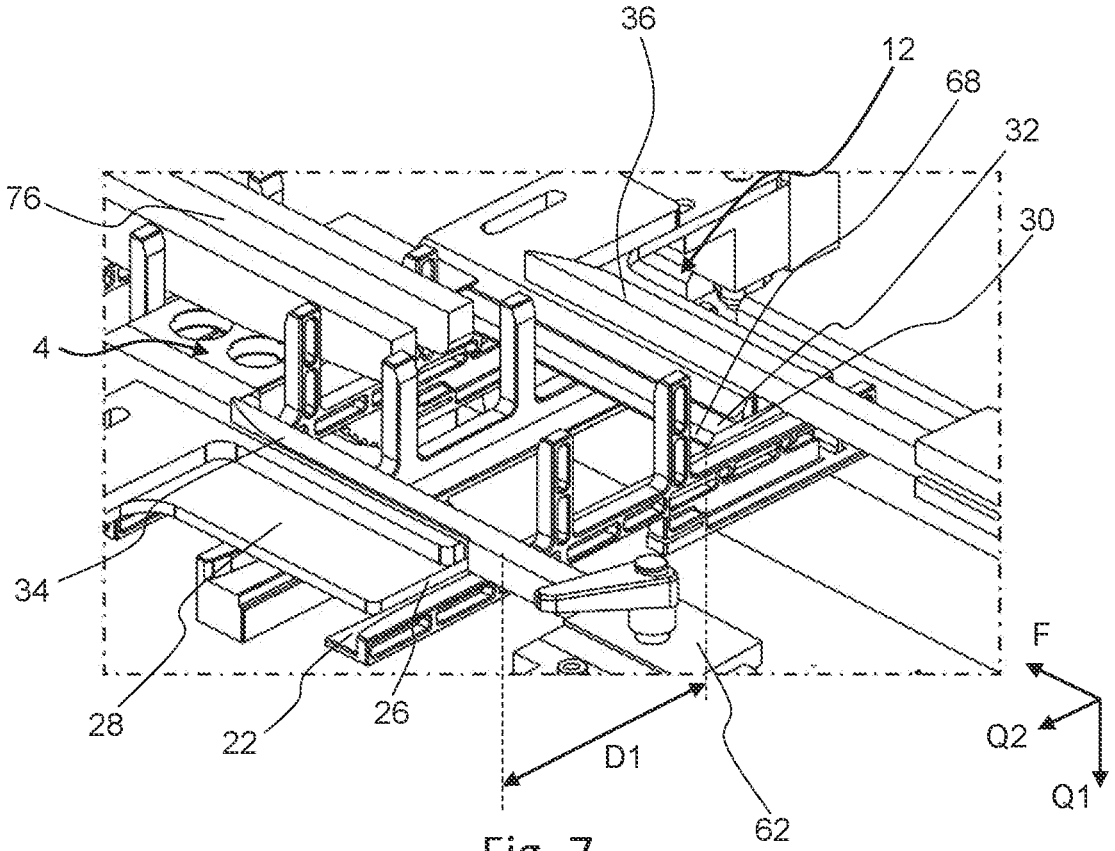

In order to fold the bottom flap 8*a* and the top flap 10*a* from the intermediate position into an end position, in which they are oriented substantially perpendicularly to the first side wall 6*a*, the package 4 is conveyed in the conveying direction F by means of the conveying device 16 as can be seen in FIGS. 6 and 7. The bottom flap 8*a* and the top flap 10*a* are increasingly folded towards the frame 6 by the first operative surface 66 and the second operative surface 68, respectively.

Further, the first push-in bar 34 and the second push-in bar 36 may be configured so as to taper in the conveying direction F, in order to permit the bottom flap 8*a* and the top flap 10*a* to approach the frame 6. Accordingly, the first operative surface 66 and the second operative surface 68 approach the conveying path 18 between the first support element 26 and the second support element 30. Finally, the first push-in bar 34 and the second push-in bar 36 end, and the first operative surface 66 and the second operative surface 68 as well as the first and the second gap 64 phase out into the conveying path 18, as can also be seen in FIGS. 3 to 7. At this time, the bottom flap 8*a* and the top flap 10*a* are in the end position, and can be held in the end position by the first support element 26 and the second support element 30 or by components of the closing device 2 which follow thereafter.

The first and the second push-in bar 34, 36 remain in the lower extreme position until the package 4 has left the start region 12 in the conveying direction F and has passed the end of the push-in bars 34, 36. Then, a new package 4 may be inserted into the closing device 2 so that the method can be repeated for this new package. To this end, the first push-in bar 34 and the second push-in bar 36 are initially moved from the lower extreme position along the movement path B to the outer extreme position. As soon as the first and the second push-in bar 34, 36 clear a receiver 20 of the conveying device 16, the next package 4 can be inserted into the closing device 2. The first and the second push-in bars 34, 36 return to the outer extreme position and move back towards the lower extreme position, whereby a bottom flap 8*a* and a top flap 10*a* of the next package 4 are folded into the intermediate position, as described above.

As can be seen in FIGS. 1 and 3 to 7, the upper bottom flap 8*b* and the upper top flap 10*b*, if present, are generally easily accessible and can be allocated and folded towards the frame 6 in a conventional manner. To this end, the closing device 2 may comprise a first rail 72 and a second rail 74 which are arranged and configured such that the upper bottom flap 8*b* and the upper top flap 10*b* initially approach the first and second rail 72, 74, respectively, along the conveying path 18. The first rail 72 and the second rail 74 then run increasingly in the first transverse direction Q1 and in the second transverse direction Q2 in order to come into contact with the bottom flap 8*b* and the top flap 10*b* from above and to fold the flaps increasingly towards the frame 6 while the package 4 is being moved in the conveying direction F. A hold-down device 76 may be provided in order to hold the package 4 in the receiver 20 in the meantime.

In this manner, the lower bottom flap 8*b* and the lower top flap 10*b* of the packages 4 can be reliably closed, even if they are only accessible with difficulty in the conveying device 16 and the use of conventional deflecting means for closing the flaps 8*b*, 10*b* is not possible or only possible with difficulty.

It goes without saying that the present disclosure is not limited to the embodiments described in detail, and further modifications and alternatives within the scope of the accompanying claims are obvious to a person skilled in the art on the basis of the description of preferred embodiments contained herein.

The invention claimed is:

1. A closing device for closing foldable packages, each package having a frame, a bottom flap and a top flap, the closing device comprising:

a conveying device for conveying the packages along a conveying path in a conveying direction, wherein the conveying device comprises a plurality of receivers, wherein each receiver has a bearing surface which delimits the receiver in a first transverse direction perpendicularly to the conveying direction and on which a package can be arranged;

a first support element having a first support surface, and a second support element having a second support surface, wherein the first support surface and the second support surface are arranged in one plane and spaced apart from the bearing surfaces of the plurality of receivers, and wherein the first support element and the second support element are arranged spaced apart from one another in a second transverse direction, wherein the bottom flap of an open package is arrangeable on the first support surface, the top flap of the open package is arrangeable on the second support surface, and the frame of the open package is arrangeable above the bearing surface, wherein the second transverse direction is oriented perpendicularly to the first transverse direction and to the conveying direction; and a first push-in bar and a second push-in bar each extending substantially parallel to the conveying direction, wherein each of the first push-in bar and the second push-in bar is cyclically movable along a movement path which has at least in some portions a component parallel to the first transverse direction in order to push the package in the first transverse direction and, at the same time, to fold the bottom flap and the top flap towards the frame.

2. The closing device of claim 1, wherein, in a first movement portion, the movement path has a component parallel to the second transverse direction in order to move the first push-in bar above the bottom flap and the second push-in bar above the top flap, and, in a second movement portion, has the component parallel to the first transverse direction in order to push the package in the first transverse direction.

3. The closing device of claim 1, wherein the first push-in bar is connected to a first drive by means of a first coupling gear and the second push-in bar is connected to a second drive by means of a second coupling gear.

4. The closing device of claim 3, wherein each of the first coupling gear and the second coupling gear comprises a first member, a second member, a third member and a fourth member, wherein the first member and the second member are pivotably mounted on a base frame of the closing device, wherein the third member is pivotably connected to the first member and to the second member, wherein the first push-in bar and the second push-in bar are rigidly connected to the third member respectively, wherein the fourth member is pivotably connected to the first member, and wherein the first drive and the second drive are coupled to the fourth member respectively.

5. The closing device of claim 1, wherein the first support element has a first operative surface which adjoins the first support surface and which, in a start region of the closing device, is inclined relative to the first transverse direction and the second transverse direction towards the conveying path, and wherein the second support element has a second operative surface which adjoins the second support surface and which, in the start region, is inclined relative to the first transverse direction and the second transverse direction towards the conveying path.

6. The closing device of claim 5, wherein the first push-in bar has an inclined side surface which, at least in the start region, is inclined relative to the first transverse direction and the second transverse direction, and wherein the second push-in bar has an inclined side surface which, at least in the start region, is inclined relative to the first transverse direction and the second transverse direction, wherein, at least in the start region of the closing device, the first operative surface and the inclined side surface of the first push-in bar are arranged substantially parallel to one another and the second operative surface and the inclined side surface of the second push-in bar are arranged substantially parallel to one another.

7. The closing device of claim 6, wherein an inclination of the first operative surface corresponds to an inclination of the inclined side surface of the first push-in bar and an inclination of the second operative surface corresponds to an inclination of the inclined side surface of the second push-in bar; and the inclination of the first operative surface and the second operative surface changes continuously along the conveying direction, in order to fold the bottom flap and the top flap further towards the frame.

8. The closing device of claim 1, wherein each of the first push-in bar and the second push-in bar has a substantially triangular cross section.

9. The closing device of claim 1, wherein the first push-in bar and the second push-in bar are configured to taper in the conveying direction.

10. A method for closing foldable packages, each package having a frame, a bottom flap and a top flap, the method comprising the steps of:

arranging an open package such that the bottom flap of the package bears against a first support surface of a first support element, the top flap of the package bears against a second support surface of a second support element, and the frame of the package is arranged above and spaced apart from a bearing surface of a receiver for the package in a first transverse direction;

arranging a first push-in bar above the bottom flap and a second push-in bar above the top flap;

moving each of the first push-in bar and the second push-in bar along a respective movement path which has at least in some portions a component parallel to the first transverse direction; and pushing the package in the first transverse direction towards the bearing surface by means of the first push-in bar and the second push-in bar during their movement along the movement path, wherein the bottom flap and the top flap are folded towards the frame by the first support element and the second support element, respectively;

wherein the step of arranging the first push-in bar and the second push-in bar comprises the steps of moving the first push-in bar above the bottom flap and moving the second push-in bar above the top flap along a first movement portion of the movement path, in which the movement path has a component parallel to a second transverse direction which is oriented perpendicularly to the first transverse direction; and the step of moving the first push-in bar and the second push-in bar comprises a movement along a second movement portion of the movement path in which the movement path has the component parallel to the first transverse direction.

11. The method of claim 10, wherein the bottom flap and the top flap are folded into an intermediate position by pushing the package in the first transverse direction, wherein the method further comprises the steps of:

conveying the package in a conveying direction by means of a conveying device which comprises the receiver, and at the same time folding the bottom flap and the top flap from the intermediate position into an end position by means of the first support element and the second support element, respectively, wherein the conveying direction is oriented perpendicularly to the first transverse direction and to the second transverse direction.

12. The method of claim 11, wherein, after the step of pushing the package in the first transverse direction towards the bearing surface by means of the first push-in bar and the second push-in bar, the bottom flap is received in a first gap between the first push-in bar and the first support element and the top flap is received in a second gap between the second push-in bar and the second support element, wherein an inclination of the first gap and the second gap relative to the first transverse direction and the second transverse direction changes along the conveying direction.

13. The method of claim 10, wherein the first support surface and the second support surface are arranged in one plane spaced apart from the bearing surface, and the first support element and the second support element are arranged at a first distance from one another in the second transverse direction, wherein the first distance is larger than a dimension of the frame of the package in the second transverse direction and smaller than a dimension of the entire open package in the second transverse direction.

14. The method of claim 10, wherein the packages are foldable trays each comprising a frame having at least four side walls, at least a first bottom flap and a second bottom flap and at least a first top flap and a second top flap, wherein in an erected state of the package adjacent side walls of the frame are oriented substantially perpendicularly to one another, wherein the first bottom flap and the first top flap each adjoin a first side wall of the frame along a fold, and the second bottom flap and the second top flap each adjoin a second side wall opposite the first side wall along a fold, wherein, in an open state of the package, the first bottom flap and the first top flap are arranged substantially in one plane with the first side wall.

15. A method for closing foldable packages, each package having a frame, a bottom flap and a top flap, the method comprising the steps of:

arranging an open package such that the bottom flap of the package bears against a first support surface of a first support element, the top flap of the package bears against a second support surface of a second support element, and the frame of the package is arranged above and spaced apart from a bearing surface of a receiver for the package in a first transverse direction;

arranging a first push-in bar above the bottom flap and a second push-in bar above the top flap;

moving each of the first push-in bar and the second push-in bar along a respective movement path which has at least in some portions a component parallel to the first transverse direction; and pushing the package in the first transverse direction towards the bearing surface by means of the first push-in bar and the second push-in bar during their movement along the movement path, wherein the bottom flap and the top flap are folded towards the frame by the first support element and the second support element, respectively;

wherein the packages are foldable trays each comprising a frame having at least four side walls, at least a first bottom flap and a second bottom flap and at least a first top flap and a second top flap, wherein in an erected state of the package adjacent side walls of the frame are oriented substantially perpendicularly to one another, wherein the first bottom flap and the first top flap each adjoin a first side wall of the frame along a fold, and the second bottom flap and the second top flap each adjoin a second side wall opposite the first side wall along a fold, wherein, in an open state of the package, the first bottom flap and the first top flap are arranged substantially in one plane with the first side wall.

16. The method of claim 15, wherein the step of arranging the first push-in bar and the second push-in bar comprises the steps of moving the first push-in bar above the bottom flap and moving the second push-in bar above the top flap along a first movement portion of the movement path, in which the movement path has a component parallel to a second transverse direction which is oriented perpendicularly to the first transverse direction; and the step of moving the first push-in bar and the second push-in bar comprises a movement along a second movement portion of the movement path in which the movement path has the component parallel to the first transverse direction.

* * * * *